US005551562A

United States Patent [19]

Beretta

[11] Patent Number: 5,551,562

[45] Date of Patent: Sep. 3, 1996

[54] CARRIER-SUITCASE FOR SPORTS GUNS, THEIR SPARE PARTS AND EQUIPMENT FOR THE USER

[75] Inventor: Ugo G. Beretta, Brescia, Italy

[73] Assignee: Fabrica D'Armi P. Beretta S.p.A., Gardone V.T. (Brescia), Italy

[21] Appl. No.: 422,145

[22] Filed: Apr. 11, 1995

[30] Foreign Application Priority Data

Jul. 20, 1994 [IT] Italy ..... BS94A0090

[51] Int. Cl.[6] ..... A45C 5/14

[52] U.S. Cl. ..... 206/317; 190/18 A; 280/47.26

[58] Field of Search ..... 190/18 A, 109–112, 190/114, 115; 206/317; 211/64; 280/47.17–47.19, 47.26–47.28; 312/216, 217, 237

[56] References Cited

U.S. PATENT DOCUMENTS

| | | | |
|---|---|---|---|
| 750,817 | 2/1904 | Crenshaw | 206/317 |
| 2,531,550 | 11/1950 | Bradley et al. | 211/64 |
| 2,706,036 | 4/1955 | Neal | 206/317 |
| 3,811,562 | 5/1974 | Smith . | |
| 4,281,843 | 8/1981 | Johnson et al. | 280/47.26 |
| 4,864,334 | 9/1989 | Ellis | 280/47.26 |
| 4,995,487 | 2/1991 | Plath | 190/111 |
| 4,998,743 | 3/1991 | Thielen | 280/47.26 |
| 5,265,950 | 11/1993 | Atkinson | 211/64 |
| 5,454,931 | 10/1995 | Lauve | 206/317 |

FOREIGN PATENT DOCUMENTS

| | | |
|---|---|---|
| 1448411 | 6/1966 | France . |
| 2280601 | 2/1995 | United Kingdom . |

*Primary Examiner*—Jimmy G. Foster
*Attorney, Agent, or Firm*—McGlew and Tuttle, P.C.

[57] ABSTRACT

The present invention pertains to a carrier-suitcase, which can be moved on wheels as a carrier and can be carried as a suitcase. It has a body, whose interior is provided with a plurality of spaces (17,19,20,23–26), which are accessible in the part on the front side and in the part on the rear side of the body and which are intended for holding, in an orderly manner, at least one sports gun, such as a rifle, spare parts for the rifle, as well as cartridges and equipment and service components for the user.

6 Claims, 2 Drawing Sheets

Fig. 2
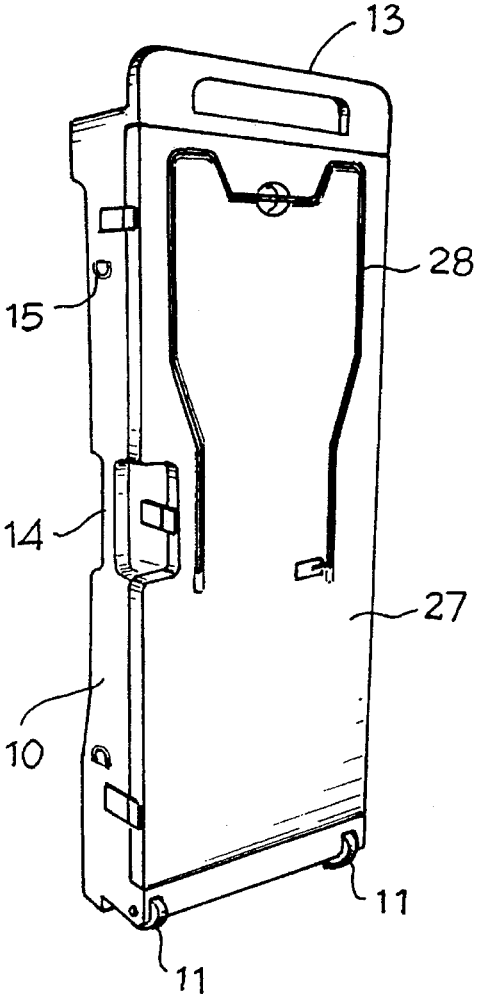
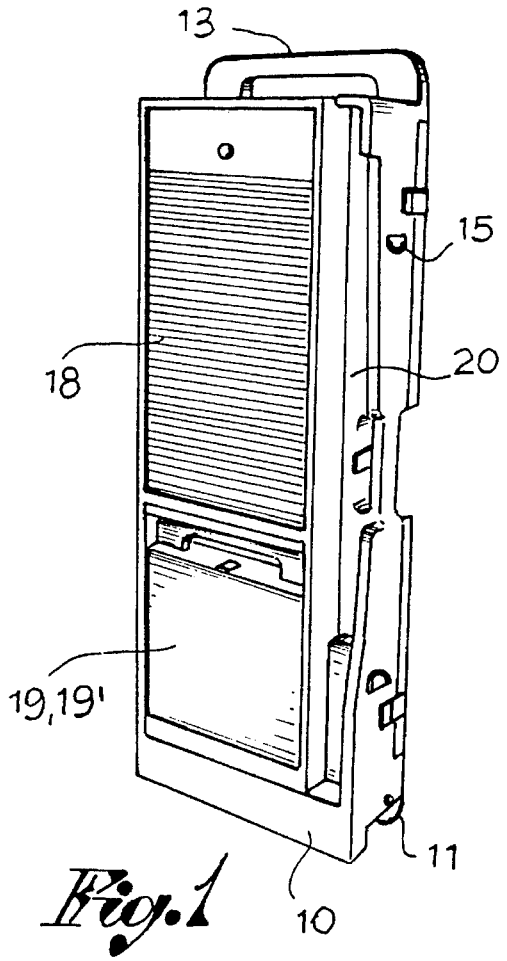
Fig. 1
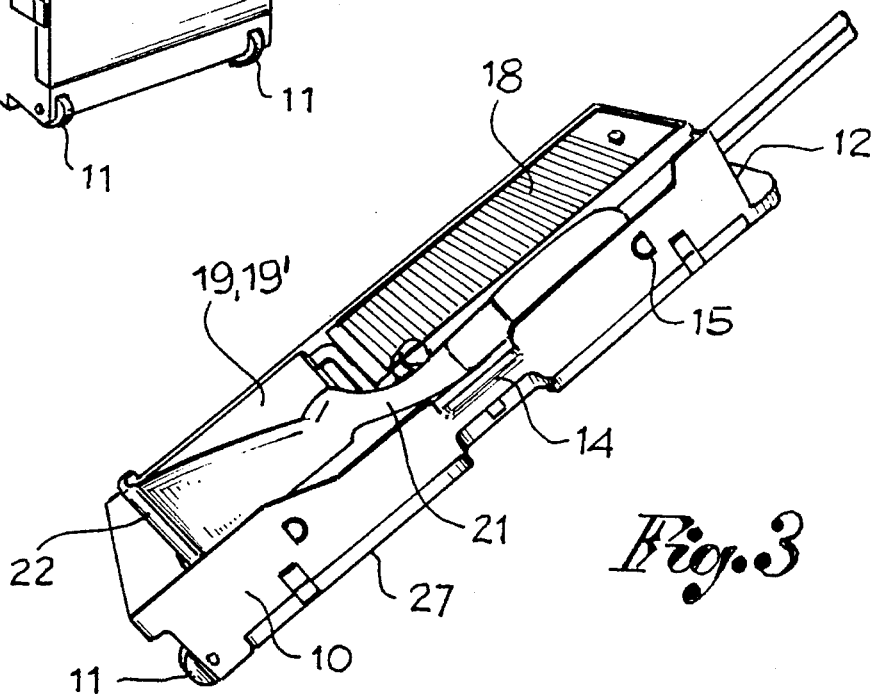
Fig. 3

CARRIER-SUITCASE FOR SPORTS GUNS, THEIR SPARE PARTS AND EQUIPMENT FOR THE USER

FIELD OF THE INVENTION

The present invention pertains to a carrier-suitcase for sports guns, particularly rifles, and for the user's equipment.

SUMMARY AND OBJECTS OF THE INVENTION

The primary object of the present invention is to provide a multifunctional container, which can be used both as a carrier and as a suitcase for the protection and the orderly transportation of at least one rifle, spare parts for the rifle, as well as cartridges and equipment and service components for the shooter.

Another purpose of the present invention is to propose a carrier-suitcase with a variety of spaces, both in its front part and in its rear part, intended for containing a variety of objects, at least one rifle either ready for use or disassembled for replacement and a small, extractable case for carrying cartridges.

According to the invention, a carrier suitcase is provided formed of a body with a bottom, a top, a first flank, a second flank, a front side and a rear side. The body is provided with wheels allowing the body to be moved on wheels as a carrier and is provided with a grip element allowing the body to be carried as a suitcase. The interior of the body has a plurality of spaces or compartments. The spaces are accessible in part on a front side and in part on a rear side of the body. The spaces or compartments are intended for holding, in an orderly manner, at least one sports gun, such as a rifle, as well as cartridges and equipment and service components for the user. The grip and/or shoulder strap is provided on the first flank of the body. At least some of the spaces which are accessible on the front side are closed by a shutter or sliding gate. Spaces which are accessible on the rear side are closed by a door, which is hinged on a second flank of the body and can be closed and locked on the first flank with a grip.

The carrier-suitcase of the inventor has the advantage of protecting, in a single container, all the components for shooting practice or shooting at a moving target with a sports gun and of facilitating both the carrying and the replacement of such components, always keeping them, however, within the reach of the user even when the sports practice occurs in open spaces. three month period set in the office action.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIGS. 1 and 2 are perspective views of the front and of the rear, respectively, of the carrier-suitcase, which is completely closed and can therefore be pulled by hand as a carrier and can be carried as a suitcase;

FIG. 3 is a perspective view of the carrier-suitcase closed in the position of pulling by hand and supporting an assembled rifle ready for use;

DETAILED DESCRIPTION 0F THE PREFERRED EMBODIMENT

Figure 6:
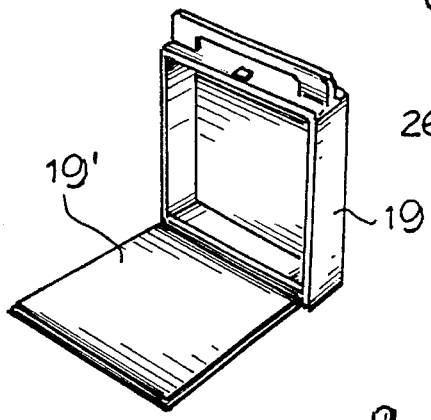
FIG. 6 is a perspective view of a small case for carrying cartridges separated from the carrier-suitcase.

The carrier-suitcase of the invention is comprised of a body 10 which can be produced with any suitable material and which has a bottom, a top, a first flank, a second flank, a front side and a rear side. The bottom of the body 10 is provided with wheels 11 for support on the ground. The top of the body 10 defines a shelf 12 for carrying objects, for example, for the support of boxes of cartridges, and is provided with a grip 13 for manually pulling the unit on the wheels 11 as a carrier (see FIG. 3). On one flank, the body has a central grip 14 for carrying the closed unit as a suitcase and rings 15 for the attachment of a shoulder strap.

A back partition 16, which is set up to divide the internal space into a compartment on the front side and a compartment on the rear side, is provided in the body 10.

Figure 4:
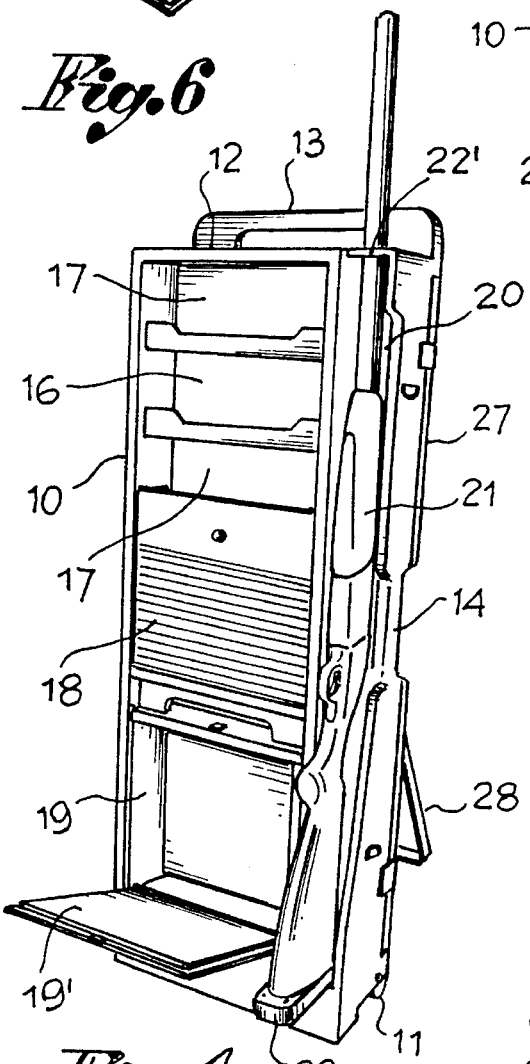
FIG. 4 is a perspective view of the front of the open carrier-suitcase, in a stationary position supported by a stand and with an assembled rifle.

A part of the compartment on the front side, for example, the upper part, is subdivided by means of shelves into a plurality of spaces for carrying objects 17, which are accessible through the opening of a closing shutter or a sliding gate 18 (see FIGS. 1, 4). The spaces 17 can be utilized to contain, for example, pieces of equipment for the shooter such as a pair of shoes, at least one pair of glasses, a couple of caps, a hat with a visor, waterproof clothing, a deerskin, and, in general, a cleaning set for the rifle and/or other personal items.

Another part of the front compartment constitutes a space for housing a small case 19 for carrying cartridges. This small case 19 can be extracted from such a space for its use as well as for independent carrying, that is, separated from the carrier-suitcase (see FIG. 6). The small case 19 for carrying cartridges has a cover 19', which can be opened even with the small case inserted into the corresponding space of the carrier-suitcase (see FIG. 4).

Another part of the front compartment defines a housing 20, which extends along the entire height of the body 10 and which is intended for accommodating an assembled rifle 21 that is ready for use. A shelf 22 is provided in the lower part of such a housing to support the butt of the rifle, a shelf which, when not used, can be folded up out of sight towards the interior of the housing so as not to protrude from the profile of the body. 0n the other hand, a locking brace 22'intended for confining the barrels of the rifle or gun in order to hold the latter in position is provided in the upper part of the housing 20.

The compartment on the rear side of the body 10 is also subdivided into more spaces, for example: a space 23 for accommodating the butt with platform balance of the rifle, a space 24 for the disassembled barrel of the same rifle, a space 25 for a spare barrel or a possible double barrel, and a space for carrying objects 26. Such a rear compartment, and therefore all its spaces 23–26, is closed by a door 27, which is hinged on the flank of the body that is opposite the flank with the central grip 14 and which is closed with appropriate locks on the flank of the body with the grip.

Figure 7:
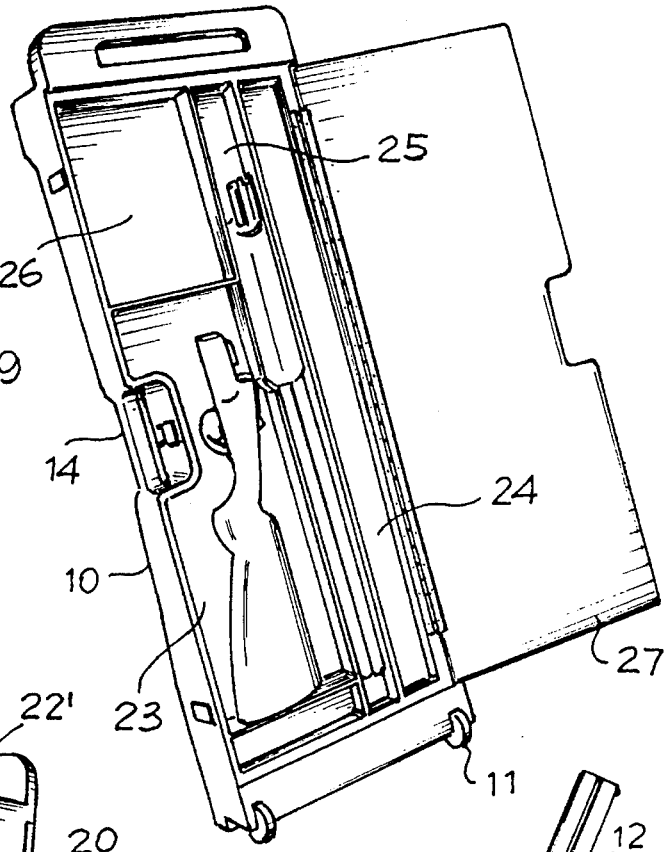
FIG. 7 is a perspective view of the rear of the open carrier-suitcase, with a disassembled and replaced rifle.
Figure 5:
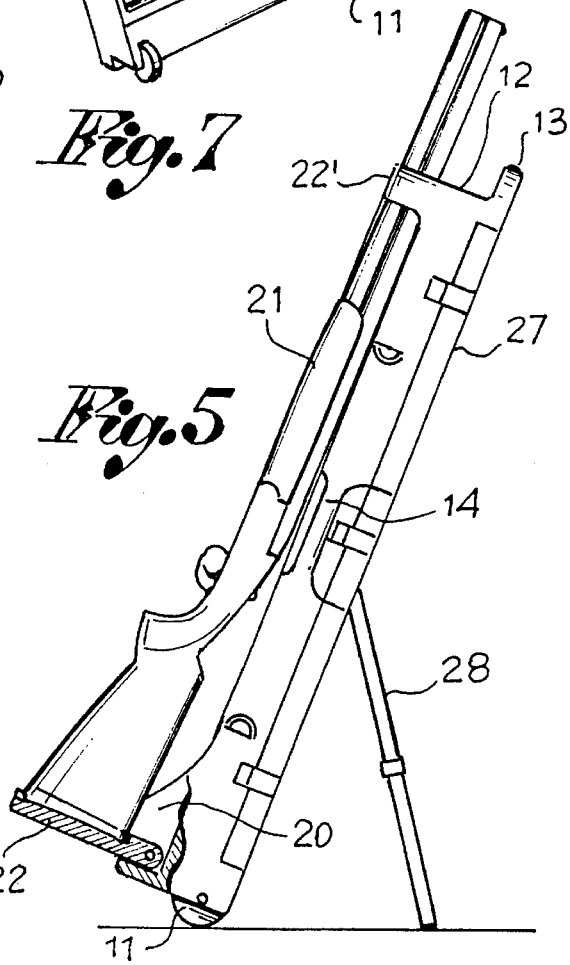
FIG. 5 is a flank view in partial section of the carrier-suitcase in the position shown in FIG. 4.

Finally, on the outer surface of the door 27 (see FIG. 7) there is mounted a support stand 28, which can be folded from a resting position, in which it is mounted and locked in a corresponding impression made in the outer surface of the door, to a use position, in which it is turned out and rests on the ground to support the carrier-suitcase in an inclined position (see FIGS. 4 and 5).

Based on the above, it is evident that the unit proposed here can be utilized comfortably both as a carrier and as a suitcase (or even with a shoulder strap) for its easy use in any situation, and that its capacity for holding countless components can be used to provide the user with spare parts, equipment and service objects that he might not be able to carry on his back or to always have within his reach.

While a specific embodiment of the invention has been shown and described in detail to illustrate the application of the principles of the invention, it will be understood that the invention may be embodied otherwise without departing from such principles.

What is claimed is:

1. A carrier-suitcase, comprising: a body with a bottom, a top, a first flank, a second flank, a front side and a rear side, the body including roller transport means for moving the carrier-suitcase over the ground as a carrier and suitcase grip means for carrying the carrier-suitcase as a suitcase, said body having an interior accessible from said front side, said interior accessible from said front side having means defining a plurality of front side spaces, and said body having an interior accessible from said rear side, said interior accessible from said rear side having means defining a plurality of rear side spaces, said spaces being formed to hold, in an orderly manner, at least one sports gun as well as cartridges and equipment and service components for the user, said roller transport means including wheels provided at said bottom of said body for support of said body over ground, said grip means including a grip for pulling the carrier-suitcase on said wheels and including one of a suitcase grip and a shoulder strap, for carrying the unit as a suitcase, said suitcase grip means being provided on said first flank of said body; a sliding gate accessible on said front side of said body for closing one or more of said front side spaces; and a door hinged to said second flank of said body for closing one or more of said rear side spaces, said door being closable and locked on said first flank, adjacent to said suitcase grip.

2. A carrier-suitcase, comprising: a body with a bottom, a top, a first flank, a second flank, a front side and a rear side, the body including roller transport means for moving the carrier-suitcase over the ground as a carrier and suitcase grip means for carrying the carrier-suitcase as a suitcase, said body having an interior accessible from said front side, said interior accessible from said front side having means defining a plurality of front side spaces, and said body having an interior accessible from said rear side said interior accessible from said rear side having means defining a plurality of rear side spaces, said spaces being formed to hold, in an orderly manner, at least one sports gun as well as cartridges and equipment and service components for the user, a back portion for sub-dividing internal spaces of said body into at least one compartment on said front side and at least one compartment on said rear side, one part of said compartment on said front side being subdivided by shelves into a plurality of spaces for carrying objects, said plurality of spaces being accessible through said sliding gate, another part of said front compartment forming a space for receiving a small case, said small case for carrying cartridges, said small case being extractable from said case space for use as an independent carrying case, another part of said front compartment defining a housing extending along an entire height of said body, said housing for accommodating an assembled rifle; an additional shelf for supporting a butt of said rifle, said additional shelf being provided in the lower part of said housing, said additional shelf being connected to said body for folding up into an interior of said housing, said compartment on said rear side of said body being subdivided into said rear side spaces, said rear side spaces including a space for accommodating a rifle butt with platform balance of the rifle, a space for a disassembled barrel of the same rifle, space for a spare barrel or a possible double barrel and a space for carrying objects, all of which are closed by said rear door.

3. A suitcase carrier according to claim 2, further comprising a stand, which can be rotationally adjusted from a resting position and is confined in said door to an open position for support on the ground, is mounted on a rear surface of said door for closing said rear spaces.

4. A carrier-suitcase, comprising: a body with a bottom, a top, a first flank, a second flank, a front side and a rear side, the body including roller transport means for moving the carrier-suitcase over the ground as a carrier and suitcase grip means for carrying the carrier-suitcase as a suitcase, said body having an interior accessible from said front side, said interior accessible from said front side having means defining a plurality of front side spaces, and said body having an interior accessible from said rear side, said interior accessible from said rear side having means defining a plurality of rear side spaces, said spaces being formed to hold, in an orderly manner, at least one a sports gun including one of a rifle and a gun having a dimension substantially corresponding to a rifle as well as cartridges and equipment and service components for the user said roller transport means including wheels provided at said bottom of said body for support of said body over ground, said grip means including a grip for pulling the carrier-suitcase on said wheels and including one of a suitcase grip and a shoulder strap, for carrying the unit as a suitcase, said suitcase grip means being provided on said first flank of said body; a sliding gate accessible on said front side of said body for closing one or more of said front side spaces; and a door hinged to said second flank of said body for closing one or more of said rear side spaces, said door being closable and locked on said first flank, adjacent to said suitcase grip.

5. A carrier-suitcase according to claim 4, further comprising a back portion for sub-dividing internal spaces of said body into at least one compartment on said front side and at least one compartment on said rear side, one part of said compartment on said front side being subdivided by shelves into a plurality of spaces for carrying objects, said plurality of spaces being accessible through said sliding gate, another part of said front compartment forming a space for receiving a small case, said small case for carrying cartridges, said small case being extractable from said case space for use as an independent carrying case, another part of said front compartment defining a housing extending along an entire height of said body, said housing for accommodating an assembled rifle; an additional shelf for supporting a butt of said rifle, said additional shelf being provided in the lower part of said housing, said additional shelf being connected to said body for folding up into an interior of said housing, said compartment on said rear side of said body being sub-divided into said rear side spaces, said rear side spaces including a space for accommodating a rifle butt with platform balance of the rifle, a space for a disassembled barrel of the same rifle, space for a spare barrel or a possible double barrel and a space for carrying objects, all of which are closed by said rear door.

6. A suitcase carrier according to claim 5, further comprising a stand, which can be rotationally adjusted from a resting position and is confined in said door to an open position for support on the ground, is mounted on a rear surface of said door for closing said rear spaces.

* * * * *